US009562669B2

(12) United States Patent
Zauritz

(10) Patent No.: US 9,562,669 B2
(45) Date of Patent: Feb. 7, 2017

(54) LAMP FOR SABBATH

(71) Applicant: KOSHER INNOVATIONS LTD., Toronto (CA)

(72) Inventor: Ilanit Zauritz, Lo Barnechea (CL)

(73) Assignee: KOSHER INNOVATIONS LTD., Toronto (CA)

( * ) Notice: Subject to any disclaimer, the term of this patent is extended or adjusted under 35 U.S.C. 154(b) by 147 days.

(21) Appl. No.: 14/635,194

(22) Filed: Mar. 2, 2015

(65) Prior Publication Data

US 2016/0209004 A1 Jul. 21, 2016

(30) Foreign Application Priority Data

Jan. 15, 2015 (CA) ..... 2877772

(51) Int. Cl.

| | |
|---|---|
| ***F21V 11/18*** | (2006.01) |
| ***F21L 14/00*** | (2006.01) |
| *F21S 9/02* | (2006.01) |
| *F21V 3/02* | (2006.01) |
| *F21V 14/08* | (2006.01) |
| *F21V 17/02* | (2006.01) |
| *F21V 29/67* | (2015.01) |

(52) U.S. Cl.

CPC *F21V 11/18* (2013.01); *F21S 9/02* (2013.01); *F21V 3/02* (2013.01); *F21V 14/08* (2013.01); *F21V 17/02* (2013.01); *F21V 29/67* (2015.01); *F21Y 2115/10* (2016.08)

(58) Field of Classification Search

CPC ..... G02F 2001/01791; F21V 11/18; F21V 11/186; F21V 11/183; F21V 14/08

See application file for complete search history.

(56) References Cited

U.S. PATENT DOCUMENTS

| | | | | | |
|---|---|---|---|---|---|
| 4,974,134 | A * | 11/1990 | Bourne | F21S 8/028 | 362/286 |
| 4,984,139 | A * | 1/1991 | Goggia | F21S 8/022 | 362/153.1 |
| 5,517,388 | A * | 5/1996 | Hutchisson | B60Q 1/2611 | 362/284 |
| 7,217,018 | B1 * | 5/2007 | Chen | B60Q 1/14 | 362/284 |
| 7,775,691 | B2 * | 8/2010 | Burgei, Jr. | F21S 8/028 | 362/153.1 |

(Continued)

*Primary Examiner* — Renee Chavez
*Assistant Examiner* — Eric T Eide
(74) *Attorney, Agent, or Firm* — Klein, O'Neill & Singh, LLP

(57) ABSTRACT

A lamp includes a light source, a cover configured to block the transmission of light from the light source, and a cover interface portion configured to interface with the cover such that the cover is disposed for upward and downward movement with respect to the light source between a first position configured to fully block the transmission of light from the light source and at least one second position configured to allow light from the light source to illuminate an area around the lamp. A track system, operatively associated with the cover, includes at least one track and at least one tracking element. The track system is configured for retaining the at least one tracking element for sliding movement along the at least one track to enable the cover to be held at various heights.

18 Claims, 7 Drawing Sheets

(56) References Cited

U.S. PATENT DOCUMENTS

| | | | | |
|---|---|---|---|---|
| 2002/0122309 | A1* | 9/2002 | Abdelhafez | B64F 1/20 362/294 |
| 2003/0026099 | A1 | 2/2003 | Dutka et al. | |
| 2005/0036322 | A1 | 2/2005 | Veffer | |
| 2005/0213330 | A1 | 9/2005 | Abish | |
| 2009/0168434 | A1* | 7/2009 | Chen | F21L 14/023 362/308 |

* cited by examiner

LAMP FOR SABBATH

CROSS-REFERENCE TO RELATED APPLICATION

This application claims priority to Canadian Patent Application Serial No. 2877772, filed on Jan. 15, 2015. The priority application is incorporated herein by reference in its entirety.

BACKGROUND

The present disclosure relates to lamps which are powered by a source of current, for example an electrical socket or a battery.

Jewish law prohibits turning lamps on or off for at least approximately a 24 hour period, for example, on the Jewish Sabbath, and on certain Jewish holidays. This period may be as long as 72 hours if the Sabbath precedes or follows certain Jewish festival days. This proscription generally prevents a person from turning a source of current or lamp switch on and off, or varying the current, for example using a dimmer switch to dim or brighten the light. However, blocking and unblocking the light mechanically is generally not proscribed. Using light timers is also not proscribed, and these devices enjoy a significant role in addressing the proscription; however their utility is limited in situations in which one cannot predict when the light is needed to be on and off.

Moving a lamp on the Sabbath is also generally proscribed.

Accordingly, there is a market among Sabbath-observant Jewish people for a lamp in which the light source can be mechanically blocked and unblocked, in the place where it has been left for use on the Sabbath. Such a lamp is particularly in demand in a bedroom so that the room can be darkened at will.

U.S. Patent Publication No. 2003/0026099 describes a lamp comprising a set of partially opaque light enveloping covers for enveloping a light source. A lamp embodying the invention described in this application is currently on the market. The lamp comprises a base configured to sit on a flat horizontal surface, a bulb operatively mounted over the base, a cylindrical light source encasement element, which is partially translucent and partially opaque, and a cover which is opaque, except for an oval aperture which allows the light to be transmitted. The cover is rotatably mounted on the light source encasement for rotation about an axis perpendicular the base. By rotating the cover about its own axis, the user can align the oval aperture with the portion of the light source encasement element which is translucent to allow the light to be transmitted through the oval aperture. Perfect alignment of the oval aperture and translucent portion of the underlying light source encasement element will transmit the maximum amount of light in the direction to which the aperture is open, whereas partial alignments transmit variable amounts of light. Rotation in at least one direction can causes complete misalignment of the oval aperture with the translucent portion of the light source encasement element to substantially block the light, for example, to darken a room for sleeping. The base and cover are provided with heat dissipating slots that are positioned to avoid transmission of light.

One of the limitations of the above lamp design is that increasingly misaligning the light encasement elements (i.e. to reduce the amount of light) also causes the light to be increasingly directionally transmitted. This limitation can be most disadvantageous when the ideal amount of transmitted light (for example to promote sleep of one individual and continued activity of other individuals) is intended to be shared by family members and the otherwise ideal locations of the respective family members in the room for whom darkness is ideal are not compatible with the direction in which transmission of light from the lamp is blocked.

For example, when bringing the lamp on a trip, if the transmitted light is meant to be substantially reduced to permit a family member (e.g. a child) to sleep while others read by its light, its placement on a night table between two hotel beds or on a breakfast table, diminishes the amount of the light for reading on one side of the table because the light is directionally transmitted via the slot. For example, if the lamp is positioned so that the direction of light transmission benefits both sides of the table equally, the alignment of the slot needs to be adjusted so that more light is transmitted into the room (contrary to what is indicated for sleeping), because this orientation of the lamp is now sub-optimal for both users.

U.S. Patent Publication No. 2005/0213330 describes a lamp adapted for Sabbath observance which comprises an opaque cover configured to be placed over an incandescent bulb. The cover is configured to be placed on (or lifted off) a cover support platform. The cover support platform and the cover together envelop the bulb to block light transmission from the light bulb. The cover must be completely removed and replaced, to alternately reveal and block the light source and therefore cannot be adjusted to vary transmission of light. Furthermore, removal of the cover may cause the cover to become separated and misplaced.

SUMMARY

The present disclosure describes an alternative structure for mechanically blocking and variably unblocking the transmission of light from a lamp. This structure is compatible with both non-directional (e.g. 360 degree illumination) and, if desired, directional transmission of light.

In a general aspect, the disclosure is directed to a lamp comprising:

at least one of a light source connector and a light source assembly;

a cover including at least one opaque wall portion, the cover configured to block the transmission of light from the light source;

a cover interface portion configured to interface with the cover such that the cover is disposed for upward and downward movement with respect to the light source between a first position which is configured to block the transmission of light from the light source and at least one second position configured to allow relatively light from the light source to illuminate an area adjacent to the lamp, optionally an area immediately around the lamp in which the light is at substantially full intensity, which area defines an arc of greater than 180 degrees, optionally greater than 230 degrees, optionally greater than 290 degrees, optionally 360 degrees;

a track system comprising at least one track and at least one tracking element, the track system configured for retaining the at least one tracking element for sliding movement along the at least one track;

wherein at least one of the cover and the cover interface portion comprises the track and at least the other of the cover and the cover interface portion comprises the tracking element; and wherein the at least one track includes at least one horizontal portion defining at least one elevated second position of the cover, and wherein the tracking system is configured such that at least one of the at least one track and the at least one tracking element is configured to retain the other of the at least one track and the at least one tracking element in the at least one second position.

In one embodiment, the present disclosure is directed to a lamp comprising a base portion, at least one of a light source connector and a light source assembly (which includes a light source by definition) supported with respect to the base portion, a cover including at least one wall portion which is substantially opaque (namely, configured to functionally block the principal transmission of light), and a cover interface portion which is optionally configured to support the cover. The cover is configured to substantially block the transmission of light from a light source. In contrast to the prior art, the cover is configured to interface with the cover interface portion such that the cover is disposed for upward and downward movement with respect to a light source between a first position which substantially blocks (relative to any one or more second positions) light transmitted from the light source and at least one second position configured to allow relatively (relative to the first position which is relatively the most light blocking position) more light from the light source to uniformly illuminate at least part of the area surrounding the lamp.

The lamp comprises a track system operatively associated with the cover and cover interface portion. The track system includes at least one track and at least one tracking element. The track system may be configured for retaining the tracking element for sliding movement along the track when the cover is rotated. At least one of the cover and the cover interface portion comprises the track and the other of the cover and the cover interface portion comprises the tracking element. The track includes at least a first portion defining at least one elevated second position of the cover and optionally a second portion defining at least one differently elevated second position of the cover. The tracking system is configured such that one of the track and the tracking element is configured to retain the other in the second position(s). The lamp optionally comprises an integrated power source, such as a rechargeable battery. In one embodiment, the power system does not utilize battery power, and the lamp comprises a corded plug configured to be plugged into a wall outlet. Optionally, the lamp comprises a pre-installed light source, for example, a compact fluorescent bulb or LED(s). The cover is at least partially hollow and may be cylindrical. The cover may be configured to be slidably mounted over the cover interface portion for axial upward and downward movement in relation to the cover interface portion. The track system is configured to permit axial rotation of the cover (about the axis of the cover) with respect to the cover interface portion. The cover may be provided with an opaque door or window which is configured to be openable and closable to allow light to be transmitted directly when the cover is in the first and/or in a second position, for example, a slidable door or flap-type door. The cover and cover interface portion may be co-axially mounted on the base.

DETAILED DESCRIPTION

Figure 1A:
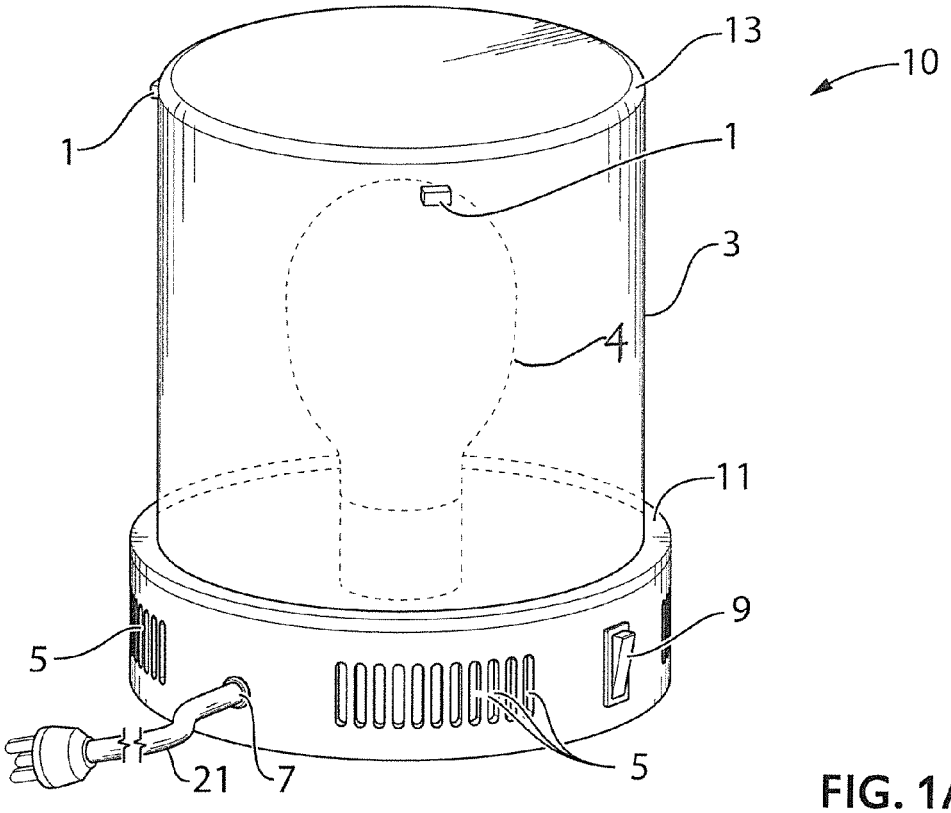
FIG. 1A is perspective view of a lamp according to one embodiment of the disclosure, shown without its opaque cover.

The term "light source connector" is exemplified by a socket and includes any receptacle or interface configured for connection to a light source (a light emitting component) in a manner that serves to supply power to the light source. The terms "light source assembly" comprises at least the light source and the light source connector to which it is connected. Preferably, the lamp, as sold, includes at least a light source connector, in a suitable format, and optionally, additionally, the light source, itself.

With reference to sliding travel of a tracking element in or on a track of the track system (which serves to define different intrinsic elevations of the cover i.e. not simply rotation of the cover about a horizontal axis to redefine the height of a light transmitting aperture), the term "upward" means intrinsic movement in a direction at least partially opposed by gravity and the term "downward" means intrinsic movement in a direction which, in principle, would be at least partially assisted by gravity. In the same vein, the term "elevated" with reference to a position of the cover, refers to a relative position which is attained via "upward" movement of the cover and the term "lowered" refers to a relative position which is attained via "downward" movement of the cover. The terms "vertically upward", "vertically downward", "vertically elevated" and "vertically lower" or "vertically lowered" mean the relative intrinsic positions or movements are functionally vertical in direction, for example, along an axis perpendicular to a horizontal lamp support surface.

The term vertical, horizontal and perpendicular mean, respectively, functionally vertical (i.e. defining intrinsically higher and lower positions), functionally horizontal (i.e. a horizontal portion a track is able retain a tracking element at a particular height) and functionally perpendicular. In relation to these terms and similar terms, which define functional locations, positions or relationships.

The term "substantially" is optionally used as a modifying term to indicate, with relatively more certainty that certain descriptive terms are being used functionally; "substantially" implying "approximately". Non-use of the term "substantially" does not imply that these descriptive are used in precise or absolute sense since the nature of the invention does not call for precision or absolutes.

Similarly the terms "opaque" and "block", with reference to the transmission of light, are not used to define absolutes but functional aspects of preventing light transmission which are designed to limit the transmission of light relative to materials which are configured to allow light transmission. For example, the cover is positionable to allow light to be transmitted to illuminate an area or areas adjacent to the lamp in one or more second positions. When in the first position, the opacity of cover serves to relatively block the transmission of light but the relative positioning does not necessarily eliminate all transmission of light. For example, even when the cover is in the first position, the lamp or cover be purposely designed to allow a modest amount of light to be transmitted, for example, if the lamp is intended to inherently provide for some transmission of light e.g. mood-lighting, or safety lighting, for example, for getting out of bed and walking a short distance in the middle of the night or for allowing a child the benefit of a modest amount of light to avoid anxiety. Accordingly, the cover may be functionally but not absolutely opaque and may have some relative small apertures configured for allowing a relatively small amount of light to be transmitted (in contrast to when the cover is in a second position designed to reversibly access principal sources of light transmission).

The term "tracking element" means any structural feature which is configured to be retained in or on (in relation to) a track. The term "track" means any structural feature configured to engage a tracking element for prescribed relative movement over a predetermined distance.

The term "surrounding" used to describe a "light source surrounding portion" of a lamp according to the disclosure, is used in a functional sense to describe locations or positions of the structural elements of the cover interface portion. In a functional sense, the word "surround" simply implies that portions of the cover interface portion are located peripherally, minimally, on at least on two approximately opposite sides of the light source, optionally in symmetrical locations with respect to the light source to provide at least two opposed cover support pillars. Depending on the configuration of the "light source surrounding portion" light is transmitted between the parts thereof and/or through the light source surrounding portion (i.e. it may be at least partially translucent). The term "substantially full intensity" implies that the light is not blocked from directly reaching the area in question.

As seen FIG. 1A, a lamp 10, according to one embodiment, comprises a cover interface portion 3, optionally in the form of a cover supporting portion which independently (by itself) supports a cover 18 (FIG. 2A) for upward and downward movement in relation to a light source 4. The cover supporting portion 3 may be configured to be a light source surrounding portion, for example a sleeve-like portion over which the cover 18 is slidably mounted. In the embodiment shown in FIGS. 1A and 1B, the light source surrounding portion 3 is optionally configured as a light source encasement element 3 which is fully translucent. The translucent light source encasement element 3 is configured to be mounted on a base 11, and together with the base, fully surrounds the light source. The translucent light source encasement element 3 may include a sidewall portion 13 which is translucent.

The base 11 is configured to have openings or vents 5 for releasing heat generated by the light source 4. The venting is optionally sufficient to enable the light source 4 to remain "on" continuously for a period of at least 24 hours and preferably as long as 72 hours. The bottom of the base (not shown) may be configured to have additional heating vents.

The light source 4 may be of any type, including, without limitation an incandescent light bulb, an LED, and a compact fluorescent bulb. Light sources, such as bulbs or LEDs are generally categorized by their efficiency, the number of watts of energy they consume, and the number of lumens of light they output. As discussed below, in terms of heat output, incandescent bulbs are generally not recommended for lamps intended for extended on-times, because they would require unnecessarily elaborate heat dissipation technologies to dissipate the heat they generate. Methods for dissipating heat in a lamp are well known to a person skilled in the art. For example, published U.S. application Ser. No. 10/900,172 describes a particular heat dissipation system for lamps especially intended for extended on-times.

Due to the high heat output of traditional incandescent bulbs, their utility for extended on times is limited. Compact fluorescent light bulbs (CFLs) are a better choice and for greatest safety may be selected to not exceed a maximum of 15 watts. Light emitting diodes (LEDs) that have similar heat output characteristics to those produced by 15 watt CFL bulbs are also safest for use. A heat sink may be used to passively remove heat from the CFL or LED assembly. For example, the metal heat sink fins may extend immediately below the LEDs towards a series of vent holes that vent beneath the lamp base.

LEDs are generally preferred for a lamp that is designed to be compact and used for travel. CFL bulbs are more fragile and are more likely to break so they are less recommended for a travel lamp. In terms of lifespan, LEDs are generally rated to last longer, but CFL bulbs are also suitable as they have a lower unit cost and still have an excellent lifespan. CFLs also perform better when they are left on for extended periods (as opposed to quicker on/off sessions).

The lamp may be battery operated, for example via a rechargeable battery, or it may be powered by both a battery and via an electrical outlet, or may be outfitted solely with a power cord 21 for plugging into an electrical outlet.

In a preferred embodiment, the bulb is selected to both have a long life and of to be of a type and specification (in terms of efficiency and maximum wattage) which generates an amount of heat over a period of 72 hours of on-time that is safely dissipated by the heat vents 5 and heat sink materials and arrangements well known to those skilled in the art. Optionally, a small fan may be incorporated in the lamp to help to dissipate the heat.

A light switch 9 is optionally provided in any convenient location, and may, for example, be provided on the base 11 as seen in FIG. 1A or on the power cord 21. The power cord 21 is configured to be held in place through an aperture 7 in the base. The aperture 7 is preferably outfitted with a conventional annular plastic clip (not shown) for more securely holding the power cord in place, preventing the cord from being cut and preventing disconnection from electrical contact points.

Tracking elements in the form of rectangular projections 1 are optionally provided on the light source encasement element 3. The projections 1 may also be configured in other shapes.

Figure 2B:
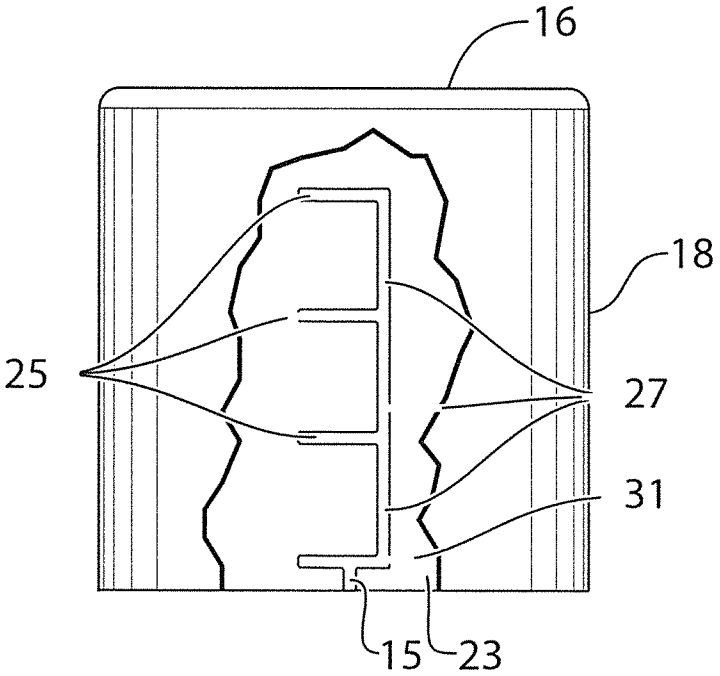
FIG. 2B is a side view, partially in section, of an embodiment of an opaque cover for the lamp of FIG. 1A, showing the track.
Figure 2A:
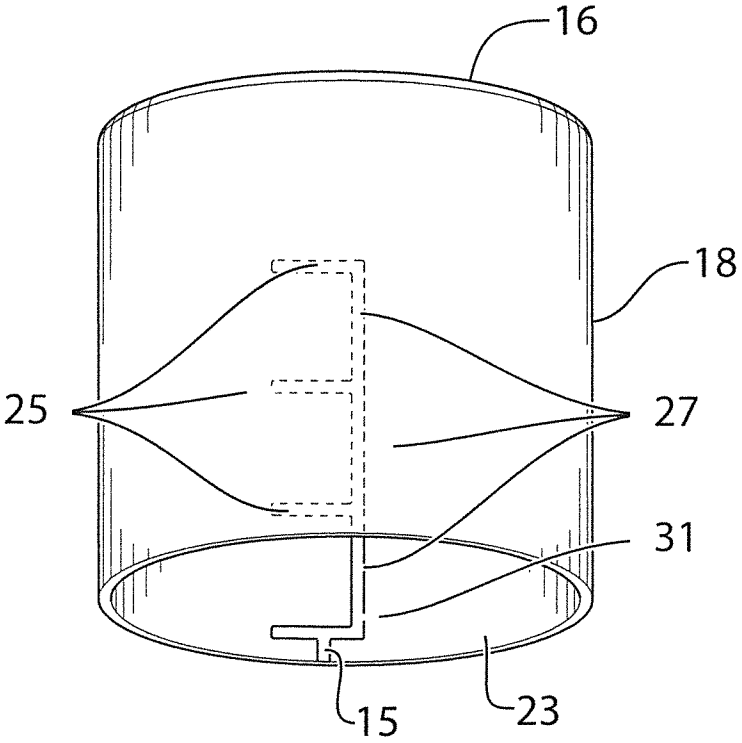
FIG. 2*a* is a bottom perspective view of an embodiment of an opaque cover for the lamp of FIG. 1A.

The vertical position of the projections 1 on the light source encasement element 3 is selected to be matched to the vertical height of the substantially horizontal portions 25 of the corresponding tracks 31, as shown in FIGS. 2A and 2B, and in particular the upper most horizontal portion 25, which positions the cover in the closed position immediately above the base, as best understood looking at FIG. 2B. Optionally, for providing a series of elevated cover positions offering the greatest amount of light transmission, these projections 1 are preferably located proximal to the top of the light source encasement element 3 as seen in FIG. 1A.

Figure 1B:
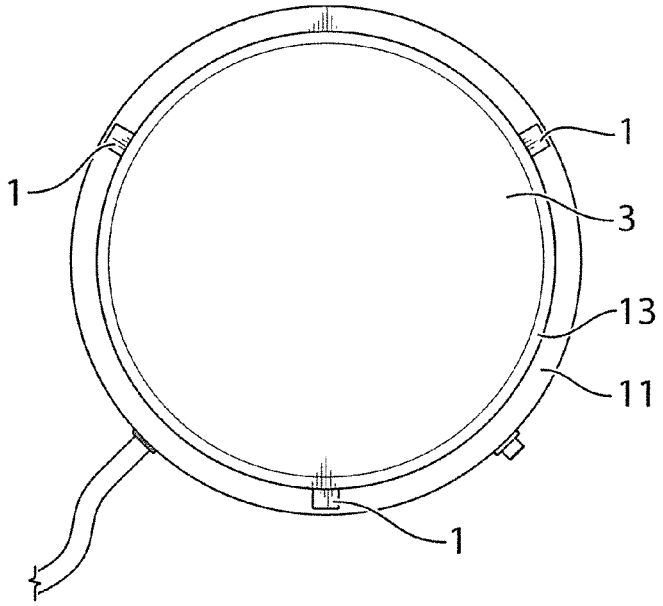
FIG. 1B a top plan view of the lamp of FIG. 1A, shown without its opaque cover.

As seen in FIG. 1B, in the embodiment of the lamp shown in FIG. 1A, the translucent light source encasement element 3 is provided with three tracking elements in the form of rectangular projections 1 that are substantially evenly spaced around the perimeter of the light source encasement element 3, and the cover 18 is provided with three tracks with corresponding spatially aligned horizontal and vertical portions 25, 27 (FIGS. 2A and 2B), so that the cover 18 can ride on all three projections 1 simultaneously.

As seen in FIGS. 2A and 2B, the cover 18 has a top wall 16, which may be opaque, connected to an inner wall 23 which is provided with a groove or track 31 defining vertical and horizontal portions 27, 25 of the track 31. The horizontal portions 25 of the track 31 are interconnected by a vertically oriented connecting portion 27 which may have a terminal portion 15 configured for removing and mounting the cover 18. The cover 18 is advantageously vertically-adjustable, in that it provides 360 degrees of illumination. Optionally, the cover 18 may be provided with a door (not shown) or part of the translucent encasement element 3 may be opaque (not shown). The door may be, for example, a removable or permanently affixed door, for example a door mounted for operation by sliding, or rotation (e.g. hingedly connected), so that an area on one side of the lamp 10 is illuminated to a greater degree.

FIGS. 3A to 3E show how the cover 18 may be used in accordance with the embodiment of the track 31 shown in FIG. 2B. It will be appreciated that the steps shown in FIGS. 3A to 3E serve to itemize the various possible positions of the cover 18, if the cover 18 is raised incrementally. However, it is self-evident that the cover 18 can be elevated to any degree accommodated by the track 31 without first being moved to positions of intermediate height.

Figure 3A:
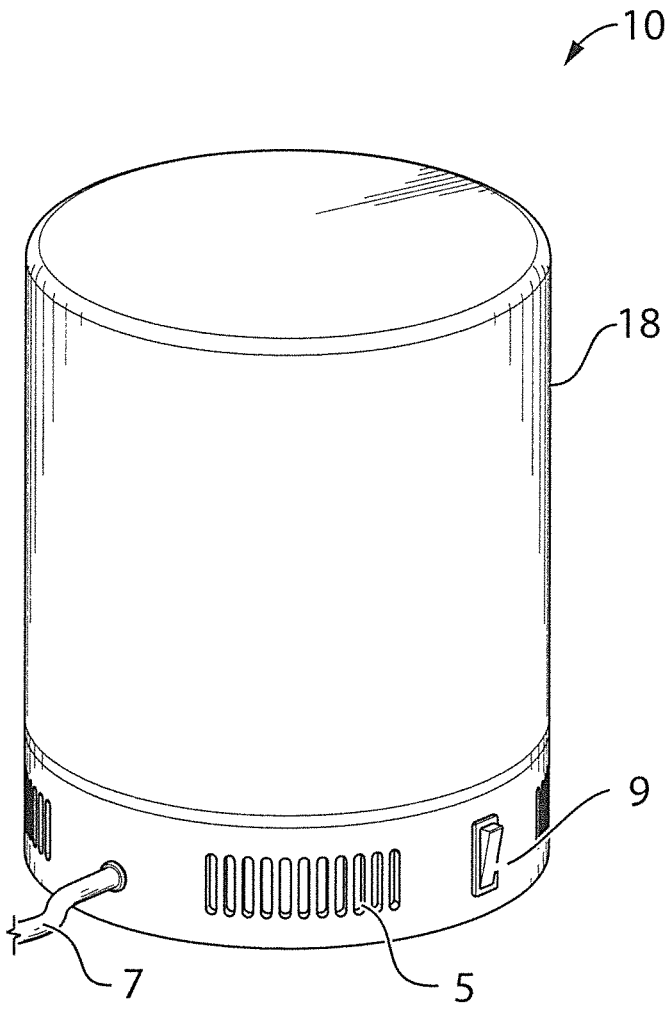
FIGS. 3A to 3E are a series of perspective views of the lamp of FIG. 1A, shown with the opaque cover seen in FIG. 2A, illustrating a set of directional cover position adjustments implementable by a lamp user to vertically move and rotate the cover; the movements suitable for re-positioning the cover from a light-blocking first position through a series of light-transmitting second positions, as well as for removing the cover.

As seen in FIG. 3A the cover 18 is positioned to completely cover the light source encasement element 3. In this position, the projections 1 are located in the uppermost portion of the vertically oriented connecting portion 27 or the upper-most horizontal track portion 25.

Figure 3B:
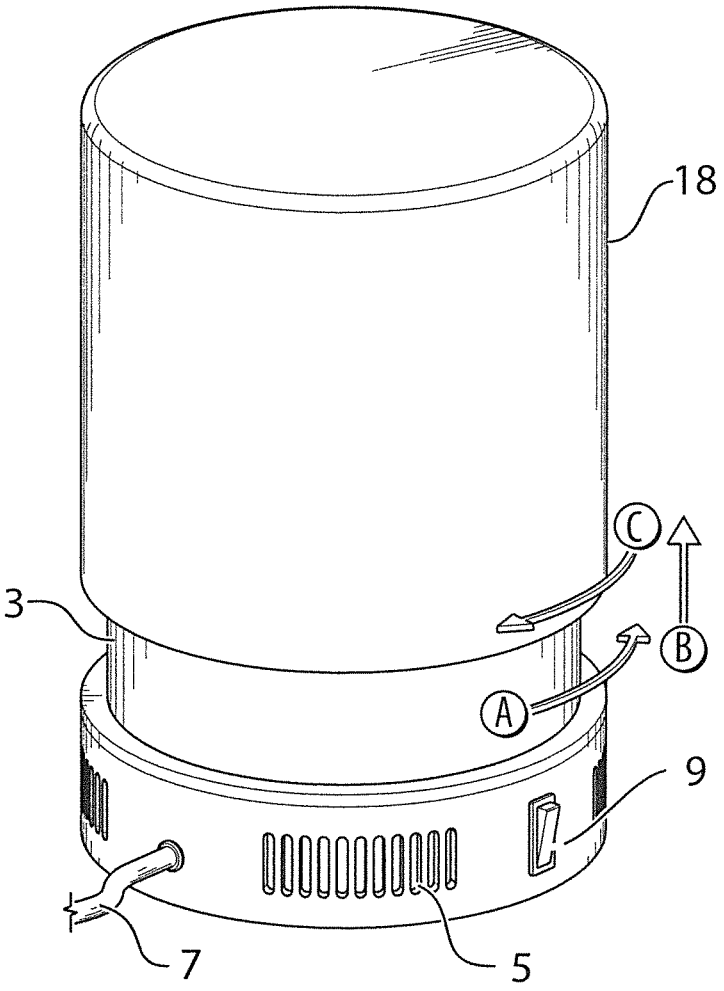

As seen in FIG. 3B, the cover 18 is movable from the fully light-blocking first position shown in FIG. 3A to a light unblocking second position. In order to raise the cover 18 so that it can be retained at the lowest second position, the cover 18 may be first rotated in one direction (step A). With respect to the configuration of the track 31 shown in FIG. 2B, this direction is clockwise. The cover 18 may then be raised to engage a upper-most portion vertical connecting portion 27 of the track 31 (step B), and then rotated counter-clockwise (step C) so that the projections 1 are sitting in the second highest horizontally oriented portion of the track 25 (i.e. second from the top).

Figure 3C:
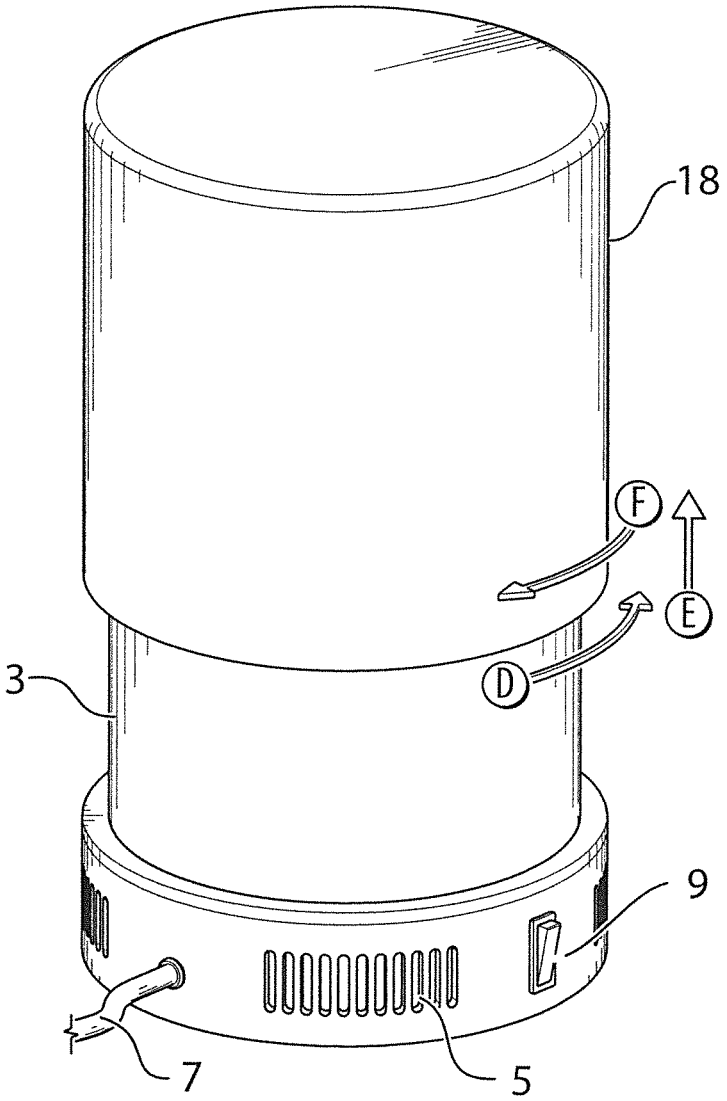
Figure 3D:
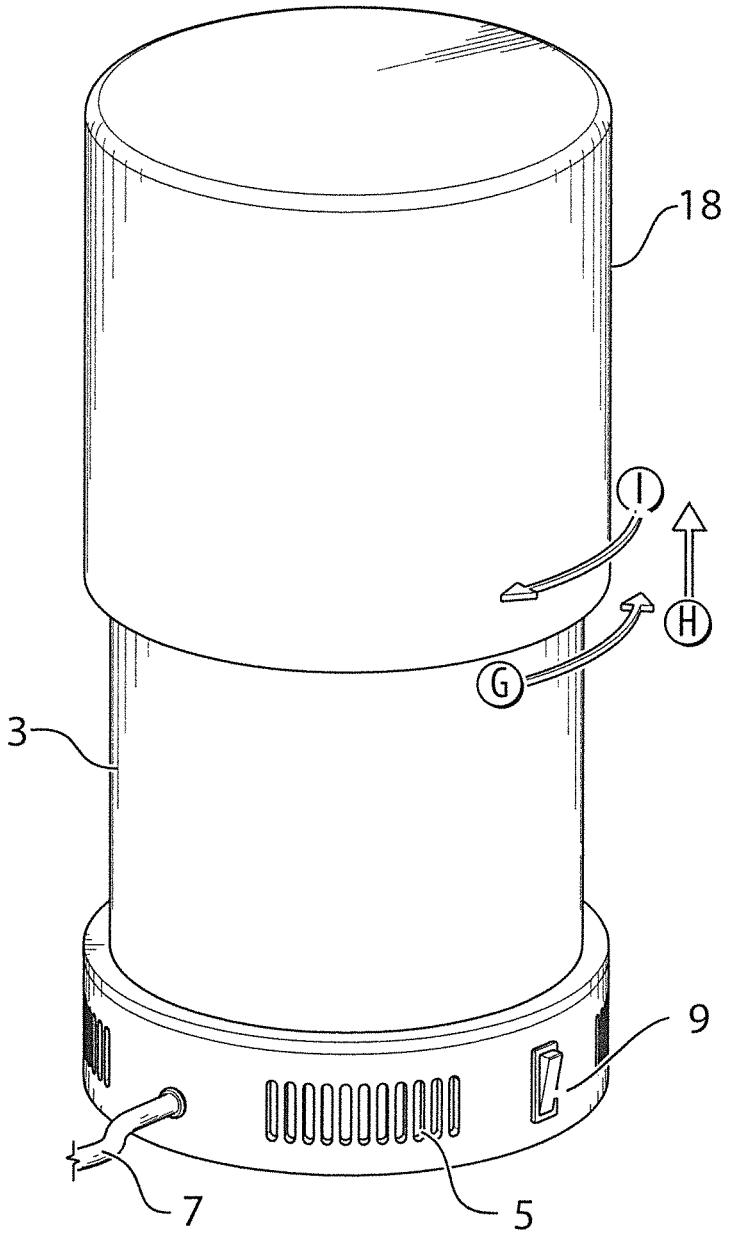
Figure 3E:
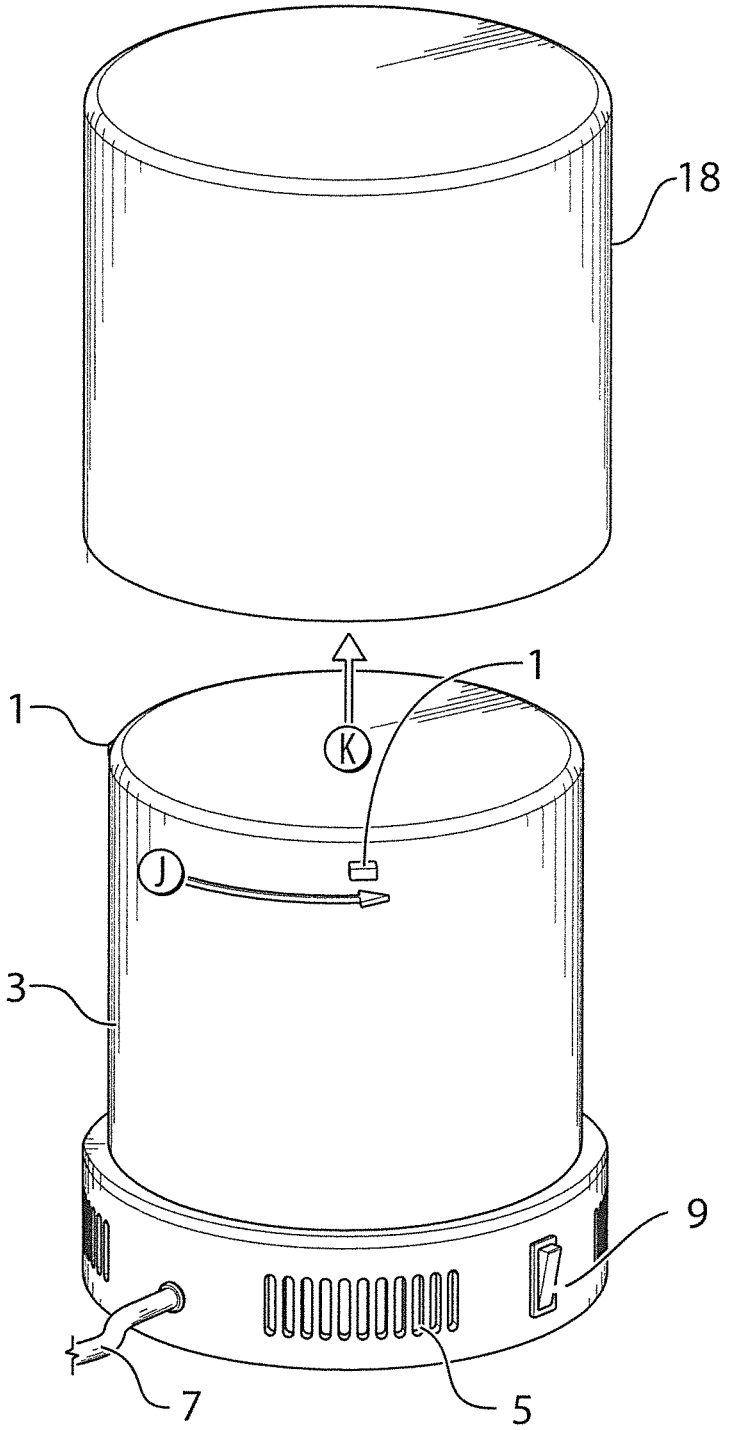

Similarly, as seen in FIGS. 3C and 3D, to progressively move the cover 18 one echelon higher, the cover 18 is rotated clockwise (steps D and G), then raised (steps E and H), and then rotated counter-clockwise (steps F and I). To remove the cover 18, the cover is rotated clockwise (step J) and then raised (step K).

The track 31 may optionally have an additional connecting portion (e.g. a vertically oriented portion), at the respective opposite sides of the horizontal portions 25 which similarly interconnect the horizontal portions 25 of the track 31, so that the cover 18 may be rotated in either direction to raise and lower the cover.

One or more of the horizontal portions 25 of the track 31 may comprise a notch portion for gravitationally receiving the tracking element 1 when the cover 18 is rotated. This feature, which serves a disengageable anti-rotation element (disengagement is achieved by simply lifting the cover 18 and rotating) may be desirable so that the cover 18 is not inadvertently rotated, or so that a child does play with the cover 18 or is unable to easily unblock the light after bedtime. If the horizontally oriented portions 25 of the track 31 are adjoined by two connecting portions, this feature would prevent the cover 18 from being over-rotated after being vertically adjusted to a desired height.

In one embodiment, the track system comprises a helical track 31 and at least one tracking element 1 configured to travel in the track 31. Optionally, a plurality of projections 1 configured to define a pitch corresponding to that of the track 31 may be provided on the cover interface portion 3 (for example a translucent light source encasement element) or on the cover 18, while the track 31 is a groove in the other of the cover 18 and the cover interface portion 3.

It is to be understood that the disclosure describes embodiments by way of example only and that the present invention is not limited to the features of the embodiments described and illustrated herein, but includes all variations and modifications within the scope of the invention as hereinafter claimed.

I claim:

1. A lamp comprising:

a base portion;

at least one of a light source connector and a light source assembly, supported with respect to the base portion;

a cover including at least one substantially opaque wall portion configured to substantially block the transmission of light from the light source;

a cover interface portion configured to interface with the cover such that the cover is disposed for upward and downward movement with respect to the light source between a first position in which the cover is positioned to substantially prevent transmission of light from the light source and at least one second position in which the cover is positioned to allow light from the light source to illuminate an area adjacent to the lamp;

a track system comprising at least one track and at least one tracking element, the track system configured for retaining the at least one tracking element for sliding movement along the at least one track;

wherein at least one of the cover and the cover interface portion comprises the track and at least the other of the cover and the cover interface portion comprises the tracking element;

wherein the at least one track includes at least one horizontal portion defining the at least one second position of the cover which is vertically elevated relative to the first position of the cover, and wherein the tracking system is configured such that at least one of the at least one track and the at least one tracking element is configured to retain the other of the at least one track and the at least one tracking element in the at least one second position; and wherein cover interface portion is a translucent light source encasement element configured to sit over the base and to be slidably receivable by the cover, the base and translucent light source encasement element cooperatively enveloping the light source, the cover configured to fully cover the translucent light source encasement element.

2. A lamp as claimed in claim 1, wherein the at least one track further comprises at least one connecting portion, the at least one connecting portion configured for interconnecting at least one of:

(a) a portion of the at least one track defining the first position of the cover and a portion of the track defining at least one second position of the cover;

(b) portions of the at least one track defining differently elevated respective second positions of the cover.

3. A lamp as claimed in claim 2, wherein the cover interface portion is configured to independently support the cover for upward and downward movement.

4. A lamp as claimed in claim 3, wherein the cover interface portion is a light source surrounding portion, at least a portion of the light source surrounding portion configured to transmit light, the cover configured to cover the light source surrounding portion in a manner which blocks the transmission of light.

5. A lamp as claimed in claim 2, wherein the at least one connecting portion includes a lower portion configured to define a first position of the cover.

6. A lamp as claimed in claim 5, wherein the lower portion includes a terminal portion configured for mounting and removal of the cover.

7. A lamp as claimed in claim 1, wherein the base portion is configured for supporting the light source on a flat surface, the base portion and the cover configured to cooperatively envelop the light source to block the transmission of light.

8. A lamp as claimed in claim 1, wherein the at least one track includes at least one vertically oriented portion configured for elevating and lowering the cover and a plurality of horizontally oriented portions connected to the at least one vertically oriented portion, the horizontally oriented portions configured for receiving the tracking element when the cover is rotated about an axis perpendicular to the base so as to hold the cover at different respective vertically elevated positions.

9. A lamp as claimed in claim 7, wherein the at least one track includes at least one vertically oriented portion configured for elevating and lowering the cover and a plurality of horizontally oriented portions connected to the at least one vertically oriented portion, the horizontally oriented portions configured for receiving the tracking element when the cover is rotated about an axis perpendicular to the base so as to hold the cover at different respective vertically elevated positions above the base.

10. A lamp as claimed in claim 1, wherein the cover includes an opaque top wall, at least one sidewall portion defining a hollow receptacle and an open bottom portion configured for receiving the translucent light source encasement element.

11. A lamp as claimed in claim 10, wherein the translucent light source encasement element and the cover are cylindrical in shape.

12. A lamp as claimed in claim 10, wherein the at least one sidewall portion includes an inner wall portion and an outer wall portion, the inner wall portion fitting closely over a sidewall portion of the translucent light source encasement element, and wherein the at least one track comprises a continuous groove in the inner wall portion and wherein the translucent light source encasement element includes at least one projection configured to travel in the groove.

13. A lamp as claimed in claim 12, wherein tracking system comprises a plurality of continuous grooves in the inner wall portion and wherein the translucent light source encasement element comprises a plurality of projections, each projection respectively defining a tracking element configured for cooperative sliding movement in one of the respective continuous grooves.

14. A lamp as claimed in claim 10, wherein the sidewall portion of the cover is opaque over its entire circumference and height.

15. A lamp as claimed in claim 10, wherein the light source encasement element comprises a sidewall portion which is translucent over its entire circumference and height.

16. A lamp as claimed in claim 14, wherein the light source encasement element comprises a sidewall portion which is translucent over its entire circumference and height.

17. A lamp as claimed in claim 1, wherein the cover interface portion is a cylindrical light source surrounding portion, the light source surrounding portion comprising a translucent sidewall portion which is translucent over its entire circumference and height, and wherein the cover comprises an inner cylindrical inner wall portion which is opaque over its entire circumference and height.

18. A lamp as claimed in claim 1, wherein the cover interface portion and the cover are configured to illuminate at least an area immediately around the lamp in which the transmitted light is at substantially fully intensity, wherein the area defines an arc of a circle greater than one hundred and eighty degrees, optionally greater than two hundred and forty degrees, optionally three hundred and sixty degrees.

* * * * *